United States Patent [19]

Roselle et al.

[11] Patent Number: 4,714,562

[45] Date of Patent: Dec. 22, 1987

[54] AUTOMATIC DISHWASHER DETERGENT COMPOSITION

[75] Inventors: Brian J. Roselle, Fairfield; Dennis W. Weatherby, Franklin, both of Ohio

[73] Assignee: The Procter & Gamble Company, Cincinnati, Ohio

[21] Appl. No.: 22,837

[22] Filed: Mar. 6, 1987

[51] Int. Cl.[4] ..... C11D 3/395; C11D 3/40

[52] U.S. Cl. ..... 252/94; 252/99; 252/135; 252/173; 252/174.21; 252/187.22; 252/187.24; 252/187.34; 252/DIG. 14

[58] Field of Search ..... 252/94, 99, 135, 174.21, 252/173, DIG. 14, 186.22, 187.23, 187.25, 187.26, 187.27, 187.28, 187.29, 187.3, 187.31, 187.32, 187.33, 187.34

[56] References Cited

U.S. PATENT DOCUMENTS

| | | | |
|---|---|---|---|
| 3,706,670 | 12/1972 | Gray | 252/186.22 |
| 3,954,675 | 5/1976 | Inamorato et al. | 252/DIG. 14 |
| 4,420,412 | 12/1983 | Wong | 252/186.36 |
| 4,464,281 | 8/1984 | Rapisarda et al. | 252/174.21 |
| 4,474,677 | 10/1984 | Foxlee | 252/186.33 |

*Primary Examiner*—A. Lionel Clingman
*Assistant Examiner*—Hoa Van Le
*Attorney, Agent, or Firm*—Robert B. Aylor; Donald E. Hasse; Steven W. Tan

[57] ABSTRACT

Detergent compositions suitable for use in automatic dishwashing machines are disclosed. The compositions contain detergency builder materials, a chlorine bleach component, an optional low-foaming, bleach-stable surfactant and a relatively water-soluble stilbene dye which is color-stable with respect to said chloride bleach component and which does not stain dishes etc.

20 Claims, No Drawings

AUTOMATIC DISHWASHER DETERGENT COMPOSITION

BACKGROUND OF THE INVENTION

Field of the Invention

This invention relates to detergent compositions containing chlorine bleach and a bleach/color/stable, non-staining dye, especially compositions which are particularly suitable for use in automatic dishwashers. The compositions are normally alkaline and contain detergency builder materials, surfactant, especially bleach-stable and/or low-sudsing surfactants and a source of available chlorine.

SUMMARY OF THE INVENTION

This invention relates to providing a stable color, preferably yellow, to conventional detergent compositions containing a chlorine bleach by relatively water-soluble stilbene dyes that are not destroyed by chlorine and which do not stain hard surfaces, e.g., dishes or dishwashers. The problem is set forth in U.S. Pat. No. 4,464,281, Rapisarda et al, patented Aug. 7, 1984, said patent being incorporated herein by reference. To avoid staining washing machines and dishware, the patentee used the more common dyes that are destroyed by bleach. Very few dyes are color-stable in the presence of chlorine bleach. See, for example, U.S. Pat. No. 4,457,855, Sudburg et al, patented July 3, 1984. Compositions of the type herein are usually colored with pigments as set forth in U.S. Pat. No. 4,271,030, Brierley et al, patented June 2, 1981.

Granular and liquid compositions are included in this invention. It is surprising that the dyes are stable in liquid compositions containing a chlorine bleach. Usually dyes are destroyed by the bleach, even in granular compositions. In particular, the invention relates to a detergent composition containing a chlorine bleach ingredient, an optional surfactant compatible with said bleach ingredient, detergent builder, and a bleach-stable, relatively water-soluble, relatively non-staining stilbene dye which comprises:

(1) from about 5% to about 90%, preferably from about 30% to about 80%, by weight of detergency builder material, or mixtures thereof, said percentages being determined on an anhydrous basis;

(2) chlorine bleach ingredient to provide from about 0.1% to about 5%, preferably from about 0.5% to about 3%, of available chlorine based on the weight of the detergent composition;

(3) from 0 to about 15%, preferably from about 0.2% to about 8% most preferably from about 0.3% to about 5%, of a preferably low foaming, preferably nonionic, bleach-stable surfactant, preferably a surfactant which is solid at 35° C. (95° F.), preferably one comprising an ethoxylated nonionic surfactant derived from the reaction of a monohydroxy alcohol or alkylphenol in which the alkyl group contains from about 8 to about 20 carbon atoms, excluding cyclic carbon atoms, with from about 6 to about 15 moles of ethylene oxide per mole of alcohol or alkylphenol on an average basis;

(4) from 0% to about 40%, preferably from about 2% to about 20%, based on the weight of the nonionic surfactant, of alkyl phosphate ester or mixtures thereof, preferably mono-$C_{18}$ alkyl phosphate esters and/or di-$C_{18}$ alkyl phosphate esters; and (5) from about 0.0005% to about 0.2%, preferably from about 0.002% to about 0.05% of chlorine bleach-stable, relatively water-soluble stilbene dye, especially dyes having Colour Index (C.I.) Constitution Index Numbers of from 40000 to 40510, which comprise stilbene and azo-stilbene dyes.

DETAILED DESCRIPTION OF THE INVENTION

Detergenecy Builder Material

Compositions of the invention contain from about 20% to about 95%, preferably from about 40% to about 90%, by weight of detergency builder component, or mixtures thereof, said percentages being determined on an anhydrous basis although the builders can be hydrated.

The detergency builder material can be any of the detergent builder materials known in the art which include trisodium phosphate, tetrasodium pyrophosphate, sodium tripolyphosphate, sodium hexametaphosphate, sodium silicates having $SiO_2$:$Na_2O$ weight ratios of from about 1:1 to about 3.6:1, sodium carbonate, sodium hydroxide, sodium citrate, borax, sodium ethylenediaminetetraacetate, sodium nitrilotriacetate, sodium carboxymethyloxysuccinate, sodium carboxymethyloxymalonate, polyphosphonates, polymeric carboxylates such as polyacrylates, and mixtures thereof. Preferably, monomeric organic detergency builder materials comprise not more than about 10% of the composition by weight.

Preferred detergency builder materials have the ability to remove metal ions other than alkali metal ions from washing solutions by sequestration, which as defined herein includes chelation, or by precipitation reactions. Sodium tripolyphosphate is a particularly preferred detergency builder material which is a sequestering agent. Sodium carbonate is a preferred precipitation detergency builder, particularly when it is desirable to reduce the total phosphorous level of the compositions of the invention. Chlorinated trisodium orthophosphate can act as both a chlorine bleach and a precipitation detergency builder material.

The inclusion of water-soluble silicates, especially sodium silicates having $SiO_2$:$Na_2O$ weight ratios of from about 1:1 to about 3.6:1 is a particularly preferred embodiment of the invention. Such silicates are a source of alkalinity useful in the automatic dishwashing process and also act to inhibit the corrosion of aluminum, glassware and ceramic glazes.

Particularly preferred compositions of the invention contain from about 15% to about 50% sodium tripolyphosphate, from about 5% to about 40% of sodium silicate solids as described hereinbefore and from 0% to about 40% sodium carbonate by weight.

Chlorine Bleach Component

The compositions of the invention can contain a chlorine bleach ingredient to provide from about 0.1% to about 5%, preferably from about 0.5% to about 3%, of available chlorine based on the weight of the detergent composition.

For granular compositions, an inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred. Sodium hypochlorite and other alkali metal hypochlorites can be used in aqueous liquid compositions.

Methods of determining "available chlorine" of compositions incorporating chlorine bleach materials such as hypochlorites and chlorocyanurates are well known in the art. Available chlorine is the chlorine which can be liberated by acidification of a solution of hypochlorite ions (or a material that can form hypochlorite ions in solution) and at least a molar equivalent amount of chloride ions. A conventional analytical method of determining available chlorine is addition of an excess of an iodide salt and titration of the liberated free iodine with a reducing agent.

The Surfactant

The compositions of the invention preferably contain from about 0.1% to about 15%, more preferably from about 0.2% to about 8%, most preferably from about 0.3% to about 6%, of preferably low-foaming surfactant, preferably one that is relatively bleach-stable in the product. For granular automatic dishwashing compositions nonionic surfactants are preferred, especially those which are solid at 35° C. (95° F.), more preferably those which are solid at 25° C. (77° F.). Reduced surfactant mobility is a consideration in stability of the bleach component. Preferred surfactant compositions with relatively low solubility can be incorporated in compositions containing alkali metal dichlorocyanurates or other organic chlorine bleaches without an interaction that results in loss of available chlorine. The nature of this problem is disclosed in U.S. Pat. No. 4,309,299 issued Jan. 5, 1982 to Rapisarda et al and in U.S. Pat. No. 3,359,207, issued Dec. 19, 1967, to Kaneko et al, both patents being incorporated herein by reference.

In a preferred embodiment the surfactant is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkylphenol on an average basis.

A particularly preferred ethoxylated nonionic surfactant is derived from a straight chain fatty alcohol containing from about 16 to about 20 carbon atoms ($C_{16-20}$ alcohol), preferably a $C_{18}$ alcohol, condensed with an average of from about 6 to about 15 moles, preferably from about 6 to about 12 moles, and most preferably from about 7 to about 9 moles of ethylene oxide per mole of alcohol. Preferably the ethoxylated nonionic surfactant so derived has a narrow ethoxylate distribution relative to the average.

The ethoxylated nonionic surfactant can optionally contain propylene oxide in an amount up to about 15% by weight of the surfactant and retain the advantages hereinafter described. Preferred surfactants of the invention can be prepared by the processes described in U.S. Pat. No. 4,223,163, issued Sept. 16, 1980, Guilloty, incorporated herein by reference.

The most preferred composition contains the ethoxylated monohydroxyalcohol or alkyl phenol and additionally comprises a polyoxyethylene, polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds that meet the requirements described hereinbefore include those based on ethylene glycol, propylene glycol, glycerol, trimethylolpropane and ethylenediamine as the initiator reactive hydrogen compound. Polymeric compounds made from a sequential ethoxylation and propoxylation of initiator compounds with a single reactive hydrogen atom, such as $C_{12-18}$ aliphatic alcohols, do not provide satisfactory suds control in the detergent compositions of the invention. Certain of the block polymer surfactant compounds designated Pluronic ® R and Tetronic ® by the BASF-Wyandotte Corp., Wyandotte, Mich., are suitable in the surfactant compositions of the invention.

Because of the relatively high polyoxypropylene content, e.g., up to about 90% of the block polyoxyethylene-polyoxypropylene polymeric compounds of the invention and particularly when the polyoxypropylene chains are in the terminal position, the compounds are suitable for use in the surfactant compositions of the invention and have relatively low cloud points. Cloud points of 1% solutions in water are typically below about 32° C. and preferably from about 15° C. to about 30° C. for optimum control of sudsing throughout a full range of water temperatures and water hardnesses.

Anionic surfactants including alkyl sulfonates and sulfates containing from about 8 to about 20 carbon atoms; alkyl benzene sulfonates containing from about 6 to about 13 carbon atoms in the alkyl group, and the preferred low-sudsing mono- and/or dialkyl phenyl oxide mono- and/or di-sulfonates wherein the alkyl groups contain from about 6 to about 16 carbon atoms. All of these anionic surfactants are used as stable salts, preferably sodium and/or potassium.

Other bleach-stable surfactants include trialkyl amine oxides, betaines, etc. such surfactants are usually high sudsing. A disclosure of bleach-stable surfactants can be found in published British Patent Application 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference. Anionic surfactants are desirable for liquid compositions and are typically used at relatively low levels, e.g. from about 0.2% to about 3%.

The preferred surfactants of the invention in combination with the other components of the composition provide excellent cleaning and outstanding performance from the standpoints of residual spotting and filming. In these respects, the preferred surfactants of the invention provide generally superior performance relative to ethoxylated nonionic surfactants with hydrophobic groups other than monohydroxy alcohols and alkylphenols, for example, polypropylene oxide or polypropylene oxide in combination with diols, triols and other polyglycols or diamines.

Alkyl Phosphate Ester

The automatic dishwashing compositions of the invention can optionally contain up to about 50%, preferably from about 2% to about 20%, based on the weight of ethoxylated nonionic surfactant of alkyl phosphate ester or mixtures thereof and wherein the alkyl preferably contains from about 16 to about 20 carbon atoms.

Suitable alkyl phosphate esters are disclosed in U.S. Pat. No. 3,314,891, issued Apr. 18, 1967, to Schmoka et al, incorporated herein by reference.

The preferred alkyl phosphate esters contain from 16–20 carbon atoms. Highly preferred alkyl phosphate esters are monostearyl acid phosphate and monooleyl acid phosphate, or salts thereof, particularly alkali metal salts, or mixtures thereof.

The alkyl phosphate esters of the invention have been used to reduce the sudsing of detergent compositions suitable for use in automatic dishwashing machines. The esters are particularly effective for reducing the sudsing of compositions comprising nonionic surfactants which are heteric ethoxylated-propoxylated or block polymers of ethylene oxide and propylene oxide.

The Stilbene Dye

The compositions of the invention contain bleach-stable (as to color in product), relatively water-soluble, relatively non-staining stilbene dyes, or dyes.

The stilbene dyes, as opposed to brighteners have a color in the visible range at the very low levels in the product. Preferably, the lowest level that will provide the desired color in the product is used.

Preferred dyes are those having Colour Index (C.I.) Constitution Index numbers of from 40000 to 40510 and especially those having numbers of 40000 to 40070, and more especially 40000 to 40006, which are defined as self condensation products of 5-nitro-o-toluenesulfonic acid, or its derivatives 4,4-dinitro-2,2'-stilbenedisulfonic acid or 4,4'-dinitrodibenzyl-2,2'-disulfonic acid, and the further products of their treatment with reducing or oxidising agents and 40205 to 40295 which are defined as azo-stilbene dyes formed by condensation of 4,4'-dinitro-2,2'-stilbenedisulfonic acid (or 4,4'-dinitrodibenzyl-2,2'-disulfonic acid) with aminoazo compounds. Especially preferred are dyes having C.I. Direct Yellow Dye Numbers 6, 6:1, 11, 19, 21, 23, 39, 55, 96, 103, 105, 106, and 124. 6, 11, 19, 21, 39, 96, 103, 106, and 124, are preferred. 6 and 96 are especially preferred for color reasons.

Preferred dyes are: C.I. #40000 (C.I. Direct Yellow 11) a self condensation product of 5-nitro-o-toluene sulfonic acid; C.I. #40001 (C.I. Direct Yellow 6) which is formed, e.g., by treating an aqueous solution of C.I. Direct Yellow 11 with formaldehyde in the presence of caustic; C.I. #40050 which is the condensation product of 4,4'-dinitro-2,2'-stilbenedisulfonic acid and primulene or dehydrothio-p-toluidinesulfonic acid; C.I. #40030 (C.I. Direct Yellow 19) which is formed by ethylating with ethyl chloride the hydroxy groups of the self condensation product of 5-nitro-o-toluene sulfonic acid in aqueous caustic alkaline medium in the presence of p-aminophenol; and C.I. #40045 (C.I. Direct Yellow 21) which is the condensation product of 4,4'-dinitrio-2,2'-stilbenedisulfonic acid and aniline.

These dyes comprise compounds of the following general formula in which $\phi$ represents a benzene ring:

$$B\text{-}\phi(B_{n-1})\text{—}A\text{-}_n\phi(B_n)$$

wherein A is selected from the group consisting of —CR=CR— wherein each R is selected from the group consisting of hydrogen, halogen (especially chlorine or fluorine), alkyl groups containing from one to about three carbion atoms, or carboxylate and each B is selected from the group consisting of halogen (especially chlorine or fluorine), alkyls containing from about one to about three carbon atoms, $—N(R^1)_2$, wherein each $R^1$ is either hydrogen, an alkyl containing from one to about three atoms, $—N(R^2)_2 \rightarrow 0$ wherein each $R^2$ is an alkyl group containing from about one to about three carbon atoms, $—NO_2$,

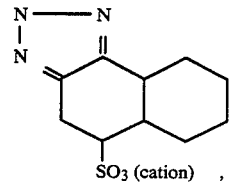

sulfonate, or carboxylate, and each n is a number from one to three, with all anionic groups having a cation which is either hydrogen or a compatible cation such as sodium, potassium, etc.

The dye is used at a level of from about 0.0005% to about 0.2%, preferably from about 0.002% to about 0.05%, most preferably from about 0.003% to about 0.02%. These dyes are mostly yellow to red in hue and the yellow dyes are especially desirable for use with an effective amount of a bleach-stable (odor) lemon perfume. These dyes are relatively water-soluble to avoid deposition. Preferably the dyes' solubility in water should be at least as much as the level it will appear in the wash solution and preferably more. Typically, the water solubility will be at least 60 ppm. In general, the more soluble a material is, the more likely it is to be attacked by bleach. It is therefore surprising that these dyes are stable in the presence of chlorine bleach, especially in liquid compositions.

Optional Ingredients

China protecting agents including soluble zinc and aluminum salts, aluminosilicates, aluminates, etc., can be present in amounts of from about 0.1% to about 5%, preferably from about 0.5% to about 2%.

Filler materials can also be present including sucrose, sucrose esters, sodium chloride, sodium sulfate, etc., in amounts from about 0.001% to about 60%, preferably from about 5% to about 30%.

Hydrotrope materials such as sodium benzene sulfonate, sodium toluene sulfonate, sodium cumene sulfonate, etc., can be present in minor amounts.

Bleach-stable perfumes (stable as to odor), crystal modifiers and the like can also be added in minor amounts.

Granular Compositions

The compositions of the invention are not restricted as to manner of preparation. The granular compositions can be prepared in any manner, including dry mixing, that results in formation of a granular product form. The process described in U.S. Pat. No. 2,895,916 issued July 21, 1959, to Milenkevich et al, and variations thereof, are particularly suitable. Also particularly suitable is the process described in U.S. Pat. No. 4,427,417, issued Jan. 24, 1984 to Porasik. Both of these patents are incorporated herein by reference.

Liquid Compositions

Liquid compositions are disclosed in U.S. Pat. No. 4,116,851—Rupe et al, issued Sept. 26, 1978; U.S. Pat. No. 4,431,559—Ulrich, issued Feb. 14, 1984; U.S. Pat. No. 4,511,487—Pruhs et al, issued Apr. 16, 1985; U.S. Pat. No. 4,512,908—Heile, issued Apr. 23, 1985; Canadian Pat. No. 1,031,229—Bush et al; European Patent Application No. 0130678—Heile, published Jan. 9, 1985; European Patent Application 0176163—Robinson, published Apr. 2, 1986; UK Patent Application GB No. 2,116,199A—Julemont et al, published Sept. 21, 1983; UK Patent Application GB No. 2,140,450A—Julemont et al, published Nov. 29, 1984; UK Patent Application GB No. 2,163,447A—Colarusso, published Feb. 26, 1986; and UK Patent Application GB No. 2,164,350A—Lai et al, published Mar. 19, 1986. All of said patents and said published applications are incorporated herein by reference.

Such aqueous thickened compositions comprise:

(1) from 0% to about 5%, preferably from about 0.1% to about 2.5% of a bleach-stable, preferably low-foaming, detergent surfactant;

(2) from about 5% to about 40%, preferably from about 15% to about 30% of a detergency builder, especially a builder selected from the group consisting of sodium tripolyphosphate, sodium carbonate, potassium pyrophosphate and mixtures thereof;

(3) a hypochlorite bleach to yield available chlorine in an amount from about 0.3% to about 2.5%, preferably from about 0.5% to about 1.5%;

(4) from about 0.1% to about 10%, preferably from about 0.5% to about 5% of a thickening agent, preferably a clay thickening agent;

(5) alkali metal silicate to provide from about 3% to about 15%, preferably from about 5% to about 12.5% of $SiO_2$; and (6) the amounts of stilbene dye set forth hereinbefore; and (7) the balance an aqueous liquid.

Hard surface cleaning compositions of all types which contain dyes can be formulated including granular and liquid scouring cleansers of the type described in U.S. Pat. Nos. 3,583,922, McClain et al, issued June 8, 1971; 4,005,027, Hartman, issued Jan. 25, 1977; 4,051,055, Trinh et al issued Sept. 29, 1977; and 4,051,056, Hartman, issued Sept. 27, 1977, all of said patents being incorporated herein by reference.

Compositions for cleaning toilets including automatic products such as disclosed in U.S. Pat. No. 4,208,747, Dirksing, issued June 24, 1980, incorporated herein by reference, can be formulated using the dyes herein although from an appearance standpoint they are not preferred.

As used herein, all percentages, parts and ratios are by weight unless otherwise stated.

The following Examples illustrate the invention and facilitate its understanding.

EXAMPLE 1

The following formula was used in evaluating the indicated yellow dyes for stability.

| | % |
|---|---|
| Sodium silicate (2.4 r) | 7.0 |
| Sodium tripolyphosphate | 23.6 |
| Sodium carbonate | 6.0 |
| Anionic surfactant (Dowfax 3B2) | 0.36 |
| Sodium hydroxide | 1.3 |
| Sodium hypochlorite | 2.2 |
| Mono stearyl acid phosphate | approximately 0.03 |
| Perfume | approximately 0.04 |
| Indicated dye | approximately 0.01 |
| Water | balance |

The color was recorded at the end of one day, three days, and three months. A dash (—) indicates that there is no observed color. The storage temperature was 100° F.

| | 1 day | 3 days | 3 months |
|---|---|---|---|
| Pontamine Yellow 3GF | orange | orange/gold | med. orange/gold |
| Erio Yellow | med. yellow | — | — |
| D&C Yellow #10 | — | — | — |
| D&C Yellow #6 | — | — | — |
| D&C Yellow #7 | — | — | — |
| F,D&C Yellow #5 | — | — | — |
| Telon Fast Yellow | — | — | — |
| Ext. D&C Yellow #3 | — | — | — |
| C.I. Direct Yellow 96 | yellow | yellow | med. yellow |
| F,D&C Yellow #1 | — | — | — |
| D&C Yellow #1 | orange | orange | very light orange |
| Sandolan yellow | — | — | — |
| Basacid Yellow 226 | — | — | — |
| Calacid yellow | — | — | — |
| Acidol yellow RE200 | very light yellow | — | — |

EXAMPLE II

The following formula was used in evaluating the indicated dyes for stability.

| | % |
|---|---|
| Sodium silicate (2.4 r) | 7.0 |
| Sodium tripolyphosphate | 23.6 |
| Sodium carbonate | 6.0 |
| Anionic surfactant (Dowfax 3B2) | 0.36 |
| Sodium hydroxide | 0.62 |
| Sodium hypochlorite | 1.0 |
| Mono stearyl acid phosphate | 0.03 |
| Perfume | 0.04 |
| Indicated dye | As indicated |
| Bentonite clay | 1.1 |
| Water | balance |

The products were stored at 40° F., 70° F., 100° F., and 120° F. respectively for three weeks.

The first dye tested was Diphenyl Brilliant Flavine 7GFF Dye (C. I. Direct Yellow 96).

The products contained 0, 0.01%, 0.,02%, 0.03%, 0.04%, and 0.05% of the dye. The color readings from a Hunter meter were as follows:

| Color | Initial | 40° F. | 70° F. | 100° F. | 120 ± F. |
|---|---|---|---|---|---|
| Undyed | L 77.2 | 76.5 | 79.1 | 79.8 | 81.0 |
| Control | a −1.8 | −1.7 | −2.0 | −2.2 | −2.0 |
| | b 8.3 | 8.2 | 9.2 | 10.3 | 10.0 |
| 96 @ .01 | L 77.6 | 77.2 | 78.3 | 80.0 | 80.2 |
| | a −4.8 | −4.9 | −4.9 | −4.8 | −4.7 |
| | b 14.5 | 15.0 | 15.5 | 15.9 | 15.7 |
| 96 @ .02 | L 77.9 | 76.8 | 78.5 | 80.8 | 81.0 |
| | a −6.5 | −6.5 | −6.6 | −6.4 | −6.2 |
| | b 18.3 | 18.6 | 19.6 | 19.7 | 19.6 |
| 96 @ .03 | L 77.2 | 76.9 | 79.3 | 79.8 | 80.1 |
| | a −7.7 | −7.8 | −7.9 | −7.5 | −7.2 |

-continued

| Color | Initial | 40° F. | 70° F. | 100° F. | 120 ± F. |
|---|---|---|---|---|---|
| | b 21.3 | 21.7 | 22.6 | 22.6 | 22.1 |
| 96 @ 0.4 | L 77.1 | 77.1 | 78.3 | 80.2 | 79.9 |
| | a −8.5 | −8.6 | −8.6 | −8.4 | −8.0 |
| | b 23.2 | 23.7 | 24.6 | 24.7 | 24.3 |
| 96 @ .05 | L 76.9 | 76.5 | 78.9 | 77.6 | 80.4 |
| | a −9.1 | −9.2 | −9.4 | −9.0 | −8.7 |
| | b 25.3 | 25.4 | 26.7 | 26.6 | 26.1 |

The second dye tested was Pergasol Yellow 6GP (C.I. Direct Yellow 6) at 0, 0.02%, 0.01%, 0.008%, 0.005%, and 0.003%. The color readings were as follows:

| Color | Initial | 40° F. | 70° F. | 100° F. | 120° F. |
|---|---|---|---|---|---|
| Undyed Control | L 76.0 | 76.7 | 78.1 | 79.0 | 79.2 |
| | a −1.7 | −1.8 | −2.0 | −2.4 | −2.2 |
| | b 8.1 | 8.6 | 9.4 | 10.8 | 10.6 |
| 6 @ .02 | L 72.0 | 71.0 | 72.1 | 73.3 | 72.6 |
| | a −2.3 | −1.6 | −0.8 | 0.2 | 0.6 |
| | b 32.2 | 33.1 | 34.5 | 34.9 | 34.2 |
| 6 @ .01 | L 73.8 | 73.2 | 74.1 | 75.9 | 75.9 |
| | a −4.8 | −4.4 | −3.9 | −3.1 | −2.7 |
| | b 29.7 | 30.9 | 31.9 | 32.8 | 31.1 |
| 6 @ .008 | L 73.9 | 73.0 | 74.4 | 76.0 | 75.9 |
| | a −5.0 | −4.6 | −4.2 | −3.4 | −3.1 |
| | b 27.6 | 28.8 | 30.1 | 30.2 | 28.4 |
| 6 @ 0.005 | L 74.4 | 74.0 | 75.5 | 76.7 | 77.1 |
| | a −5.1 | −4.9 | −4.6 | −3.9 | −3.4 |
| | b 24.9 | 26.2 | 27.5 | 27.0 | 24.5 |
| 6 @ .003 | L 75.5 | 75.0 | 76.1 | 78.0 | 77.9 |
| | a −4.7 | −4.7 | −4.5 | −3.6 | −2.9 |
| | b 20.2 | 21.6 | 22.6 | 21.3 | 18.3 |

The last color tested was a pigment, Ponolith Yellow 2GN-P, the cllor of which is bleach-unstable. The levels were 0, 0.001%, 0.002%, 0.003%, 0.004%, and 0.005%. The results were as follows:

| Color (1 week results) | Initial | 40° F. | 70° F. | 100° F. | 120° F. |
|---|---|---|---|---|---|
| Undyed Control | L 77.5 | 76.5 | 77.2 | 79.6 | 79.1 |
| | a −1.8 | −1.7 | −1.8 | −2.2 | −2.2 |
| | b 8.4 | 8.3 | 8.7 | 10.5 | 10.6 |
| 2GN-P @ .001 | L 76.3 | 75.6 | 76.9 | 78.8 | 79.9 |
| | a −7.8 | −8.0 | −7.4 | −3.2 | −2.4 |
| | b 24.4 | 24.8 | 23.1 | 12.7 | 11.0 |
| 2GN-P @ .002 | L 76.5 | 76.0 | 77.0 | 79.3 | 79.4 |
| | a −9.0 | −9.4 | −8.8 | −3.9 | −2.5 |
| | b 28.5 | 29.2 | 26.8 | 14.2 | 11.1 |
| 2GN-P @ .003 | L 76.1 | 75.3 | 76.8 | 79.2 | 80.1 |
| | a −10.5 | −10.9 | −10.3 | −4.7 | −2.5 |
| | b 33.6 | 34.1 | 31.9 | 16.4 | 10.8 |
| 2GN-P @ .004 | L 75.3 | 75.1 | 76.2 | 78.7 | 79.5 |
| | −11.0 | −11.4 | −10.8 | −5.1 | −2.5 |
| | b 35.3 | 35.9 | 33.7 | 17.5 | 11.2 |
| 2GN-P @ .005 | L 75.7 | 75.2 | 76.1 | 79.3 | 79.4 |
| | −11.5 | −11.8 | −11.2 | −5.6 | −2.5 |
| | b 37.1 | 37.5 | 35.5 | 18.9 | 11.3 |

The "b" values are the best indicator of stability. Both the Direct Yellow 96 and the Direct Yellow 6 are relatively stable while the Ponolith Yellow loses essentially all color. The Direct Yellow 6 is the most effective on an equal weight basis in meeting the desired color intensity.

EXAMPLE III

An agglomerated automatic dishwasher composition has the formula:

| Component | % |
|---|---|
| Sodium tripolyphosphate | 33.17 |
| Nonionic surfactant | 2.04 |
| $Na_2SO_4$ | 10.04 |
| $Na_2CO_3$ | 30.00 |
| Sodium silicate (2.4 r) | 22.46 |
| Sodium dichlorocyanurate dihydrate | 1.78 |
| Perfume | 0.17 |
| Dye (as indicated) | — |

When stored at 70° F. and 100° F. the initial and four week color readings were as follows:

| Dye | Initial 70° F. | 70° F. | Initial 100° F. | 100° F. |
|---|---|---|---|---|
| C.I.6; 0.02% | L 88.9 | 89.1 | 89.2 | 89.8 |
| | a −2.6 | −2.1 | −2.6 | −0.9 |
| | b 29.5 | 29.1 | 29.3 | 25.4 |
| C.I.96; 0.05% | L 93.0 | 93.7 | 92.9 | 93.6 |
| | a −8.5 | −7.5 | −8.4 | −6.2 |
| | b 25.6 | 25.3 | 26.0 | 25.5 |
| C.I. | Initial 70° F. | 70° F. | Initial 100° F. | 100° F. |
| Acid Yellow 17 (unstable); 0.015% | L 90.1 | 91.9 | 89.9 | 93.9 |
| | a −4.1 | −2.6 | −4.2 | −2.2 |
| | b 22.7 | 13.9 | 23.1 | 10.0 |
| For comparison, the same product without bleach | L 91.8 | 92.0 | 91.7 | 92.0 |
| | a −9.8 | −9.9 | −10.0 | −10.3 |
| | b 37.7 | 38.3 | 38.2 | 39.8 |

What is claimed is:

1. A detergent composition comprising:
(1) from about 5% to about 90% by weight of detergency builder material on an anhydrous basis;
(2) chlorine bleach ingredient to provide from about 0.1% to about 5%, of available chlorine based on the weight of the detergent composition;
(3) from 0% to about 15% by weight of surfactant; and
(4) from 0.0005% to about 0.2% relatively water-soluble stilbene dye which is color-stable to chlorine bleach.

2. The composition of claim 1 wherein said dye is selected from dyes having Colour Index, Constitution Index numbers from 40000 through 40510 and mixtures thereof.

3. The composition of claim 2 wherein said dye is C.I. Direct Yellow 6 at a level of from about 0.0005% to about 0.05%.

4. The composition of claim 2 wherein said dye is C.I. Direct Yellow 96 at a level of from about 0.01% to about 0.15%.

5. The composition of claim 2 wherein said dye is C.I. Direct Yellow 39 at a level of from about 0.001% to about 0.15%.

6. The composition of claim 1 containing from about 30% to about 90% by weight of detergency builder material; from about 0.5% to about 3% of available chlorine; from about 0.3% to about 8% of low foaming nonionic surfactant; and from about 0.002% to about 0.05% of said dye.

7. The composition of claim 6 wherein said dye is selected from the group consisting of C.I. Direct Yellow Dyes, Numbers 6, 6:1, 11, 19, 21, 23, 39, 55, 96, 103, 105, 106, 124, and mixtures thereof.

8. The composition of claim 7 wherein said dye is C.I. Direct Yellow at a level of from about 0.0005% to about 0.05%.

9. The composition of claim 7 wherein said dye is C.I. Direct Yellow 96 at a level of from about 0.01% to about 0.15%.

10. The composition of claim 7 wherein said dye is C.I. Direct Yellow 39 at a level of from about 0.001% to about 0.15%.

11. The composition of claim 1 in the form of an aqueous liquid.

12. The composition of claim 11 containing from about 40% to about 90% by weight of detergency builder material; from about 0.5% to about 3% of available chlorine; from about 0.3% to about 8% of low foaming nonionic surfactant; from 0% to about 40% by weight of said low foaming nonionic surfactant of alkyl phosphate ester wherein the alkyl contains from about 16 to about 20 carbon atoms, and from about 0.002% to about 0.05% of said dye.

13. The composition of claim 12 wherein said dye is selected from the group consisting of C.I. Direct Yellow Dyes, Numbers 6, 6:1, 11, 19, 21, 23, 39, 55, 96, 103, 105, 106, 124 and mixtures thereof.

14. The composition of claim 13 wherein said dye is C.I. Direct Yellow 6 at a level of from about 0.0005% to about 0.05%.

15. The composition of claim 13 wherein said dye is C.I. Direct Yellow 96 at a level of from about 0.01% to about 0.15%.

16. The composition of claim 13 wherein said dye is C.I. Direct Yellow 39 at a level of from about 0.001% to about 0.15%.

17. The composition of claim 1 in the form of an aqueous thickened liquid composition comprising:

(1) from 0% to about 5% of bleach-stable, low-foaming detergent surfactant;
(2) from about 5% to about 40% of detergency builder;
(3) from about 0.3% to about 2.5% available chlorine from a hypochlorite source;
(4) from about 0.1% to about 10% thickening agent;
(5) from about 3% to about 15% $SiO_2$;
(6) from about 0.002% to about 0.05% of said stilbene dye; and
(7) the balance an aqueous liquid.

18. The composition of claim 17 wherein said dye is selected from the group consisting of C.I. Direct Yellow Dyes, Numbers 6, 11, 19, 21, 39, 96, 103, 106, 124, and mixtures thereof and additionally containing an effective amount of a bleach-stable lemon perfume.

19. The composition of claim 18 wherein there is from 0.1% to about 2.5% surfactant, from about 15% to about 30% detergency builder, from about 0.5% to about 1.5% available chlorine, from about 0.5% to about 1.5% thickening agent, from about 5% to about 12.5% $SiO_2$, and from about 0.003% to about 0.02% of said stilbene dye.

20. The composition of claim 17 wherein there is from 0.1% to about 2.5% surfactant, from about 15% to about 30% detergency builder, from about 0.5% to about 1.5% available chlorine, from about 0.5% to about 1.5% thickening agent, from about 5% to about 12.5% $SiO_2$, and from about 0.003% to about 0.02% of said stilbene dye.

* * * * *